US005161266A

United States Patent [19]

Hildebrand

[11] Patent Number: 5,161,266

[45] Date of Patent: Nov. 10, 1992

[54] PORTABLE SHOWER

[76] Inventor: Gerald R. Hildebrand, 2674 E. Main St., Ventura, Calif. 93003

[21] Appl. No.: 740,929

[22] Filed: Aug. 6, 1991

[51] Int. Cl.[5] ..... A47K 3/22

[52] U.S. Cl. ..... 4/599; 4/603; 222/475

[58] Field of Search ..... 4/599, 602, 603; 215/100 A; 220/4.13, 94 A; 222/475

[56] References Cited

U.S. PATENT DOCUMENTS

| | | | |
|---|---|---|---|
| 654,235 | 7/1900 | Dow | 222/475 X |
| 828,907 | 8/1906 | Tubbs | 222/475 X |
| 1,330,312 | 2/1920 | Figueroa | 4/602 X |
| 2,630,247 | 3/1953 | Rafferty | 222/475 X |
| 2,687,628 | 8/1954 | Cunningham | 222/475 X |
| 3,217,948 | 11/1965 | Mullen | 222/475 X |
| 3,681,788 | 8/1972 | Le Blanc et al. | 4/602 |
| 4,453,280 | 6/1984 | Greenleaf | 4/599 |
| 4,901,878 | 2/1990 | Humphries | 220/94 A |

FOREIGN PATENT DOCUMENTS

| | | | |
|---|---|---|---|
| 574528 | 7/1924 | France | 4/603 |
| 357205 | 9/1931 | United Kingdom | 4/603 |

*Primary Examiner*—Charles E. Phillips
*Assistant Examiner*—Robert M. Fetsuga
*Attorney, Agent, or Firm*—Jack C. Munro

[57] ABSTRACT

A portable shower to be used by a human being comprising a tank from which extends a vertically rising conduit assembly which terminates in a shower head. A manually operated air pressure pump is to be connected to the tank and is to function to pressurize the tank and cause water from the tank to flow through the vertically rising conduit assembly and be dispensed through the shower head into the ambient. Water from the tank is conducted through a water supply conduit into the vertically rising conduit assembly. This water supply conduit is mounted exteriorly of the tank and functions as a handle to be usable when transporting of the tank when it is not being used.

3 Claims, 2 Drawing Sheets

2
64
62
10
60
16
58
3
56
50
54
28
42
44
36
12
24
14
38
40
22
18
20
2

12
36
54
38
24
28
44

64
62
10
60
58
16
3
56
50
4
54
28
36
38
24
12
40
18
4

PORTABLE SHOWER

BACKGROUND OF THE INVENTION

1. Field of the Invention

The field of this invention relates to hygiene devices for human beings and more particularly a device that permits the human being to take a shower.

2. Description of Prior Art

The including of bathing facilities such as a shower is normal within homes, apartments, hotels and motels. However, there are instances where a human being may be located in an environment where a shower is not readily available. Such environments may be camping, boating, surfing or other types of outdoor environments. There is a need, in an outdoor environment, to make available to a human being a showering facility.

The basic concept of a portable shower for a human being has been known. Such showers have been constructed to include tanks and are adapted to be hung from trees or mounted on the top of vehicles so that such are elevated so the dispensed water would fall from the elevated position upon the human being while taking the shower. These prior art devices have been complex in construction, expensive to manufacture and as a result have not experienced any widespread usage.

There is a need to construct a portable shower which is simple in construction, can be manufactured inexpensively and therefore sold to the consumer at a relatively inexpensive price. When not in use, the portable shower is to be condensed into a small storage space. Also, the portable shower should be constructed so that it will operate repeatedly without maintenance and even if the shower is not in use for an extended length of time, when it is again used, such will operate without any problem.

SUMMARY OF THE INVENTION

The structure of the present invention is designed to overcome the objections previously noted.

The portable shower of this invention is designed to be used in conjunction with a conventional foot operated air pump with this air pump being connected to a tank. The tank is capable of holding a certain quantity of water such as five gallons. The exterior of the tank is to be coated a dark color, such as black, so that, if the tank is to be placed in the sun, the water would be heated. The tank has a water supply conduit connecting from the internal chamber of the tank exteriorly of the tank and terminates at the upper edge of the tank. Also located at the upper edge of the tank is an enlarged fill opening which is normally capped thereby closing the internal chamber to the ambient. A conduit assembly, in the form of a pluralilty of segments, is to connect with the water supply conduit and rise some preselected elevated height above the tank. The segments of the conduit assembly are to be readily disconnectable and when the portable shower of this invention is not being used, the segments are capable of being stored by being placed through the fill opening within the internal chamber of the tank. The conduit assembly terminates in a shower head at its upper outer end. The water supply conduit also functions as a handle for transporting of the portable shower when not in use.

DETAILED DESCRIPTION OF THE SHOWN EMBODIMENT

Figures 1, 2, 3:
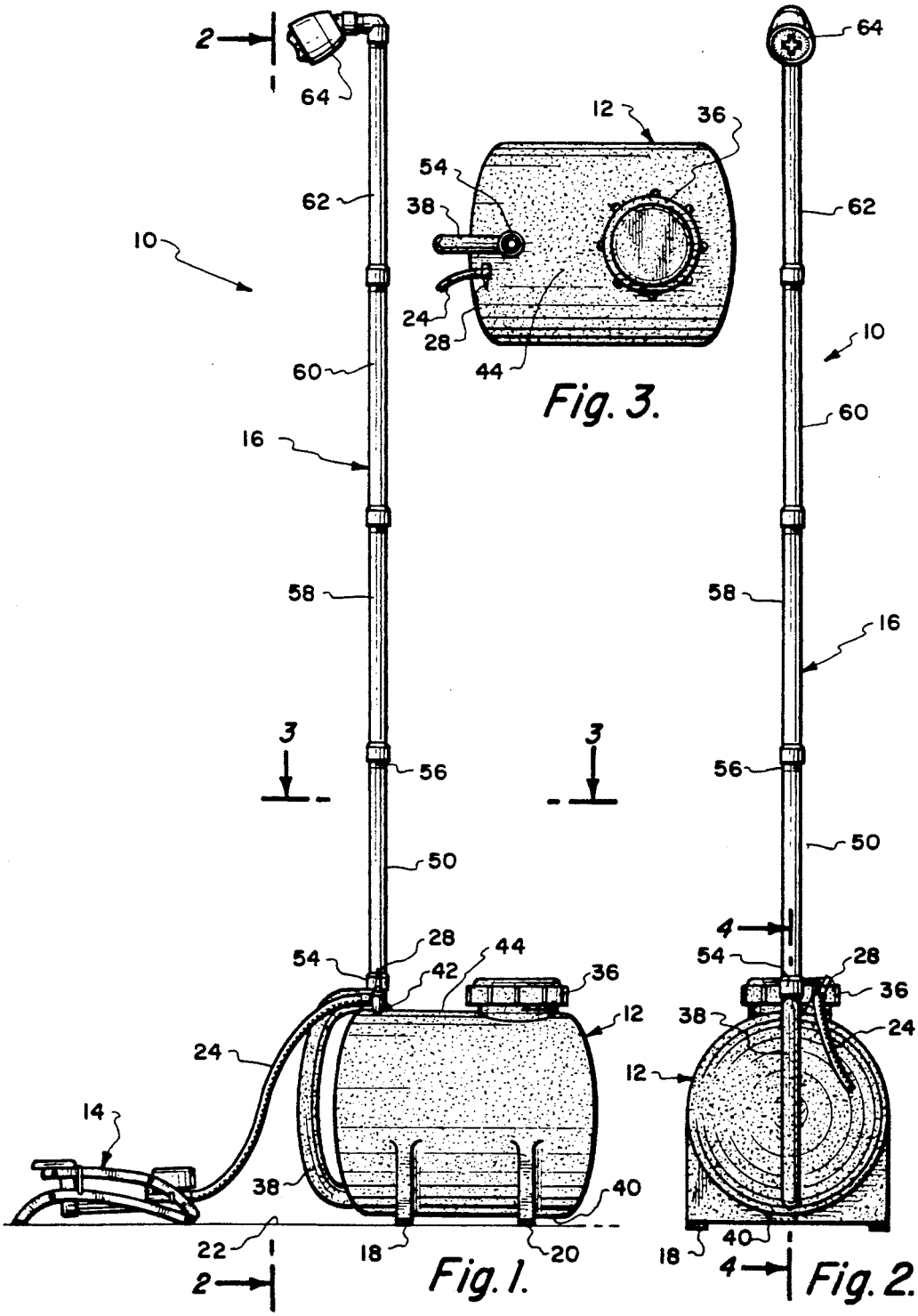
FIG. 1 is a side elevational view of the portable shower of this invention.
FIG. 2 is a front elevational view of the portable shower of this invention taken along line 2—2 of FIG. 1.
FIG. 3 is a top view of the tank utilized in conjunction with the portable shower of this invention taken along line 3—3 of FIG. 1.
Figure 4:
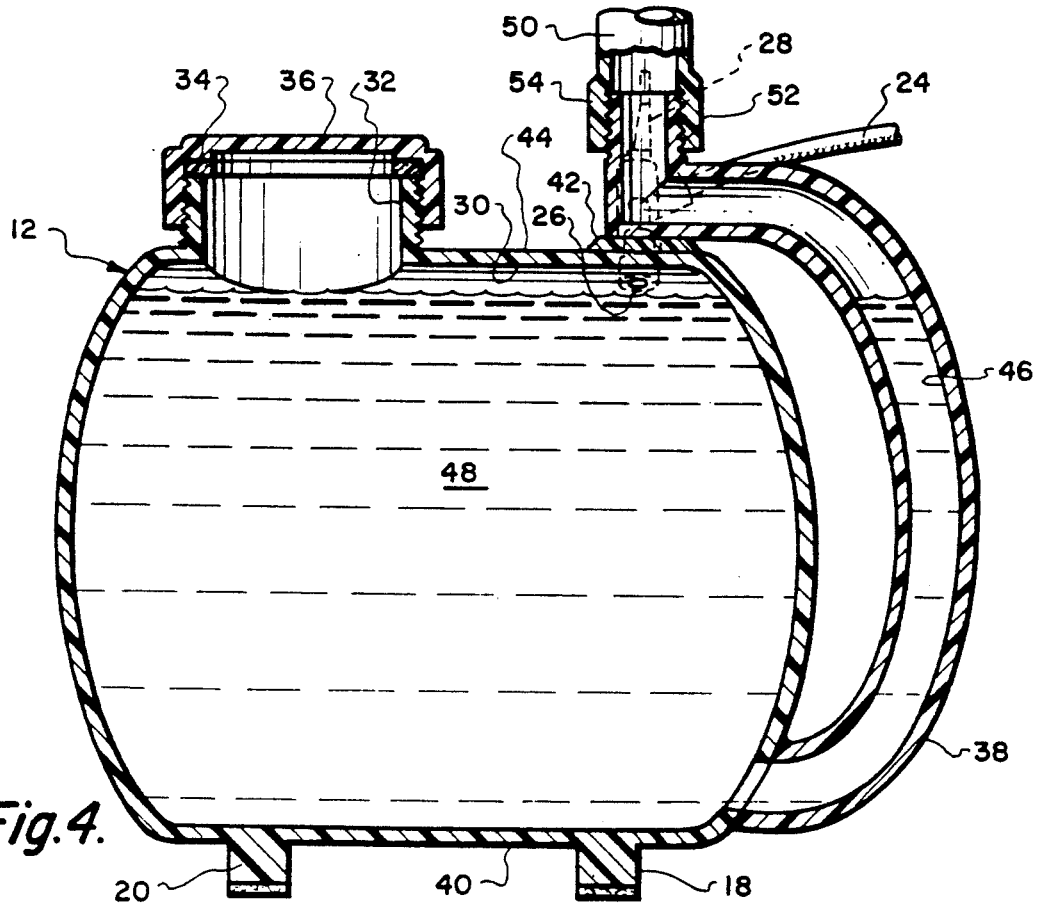
FIG. 4 is a cross-sectional view through the tank which is incorporated within the portable shower of this invention taken along line 4—4 of FIG. 2 showing the tank being filled with water ready to be used.
Figure 5:
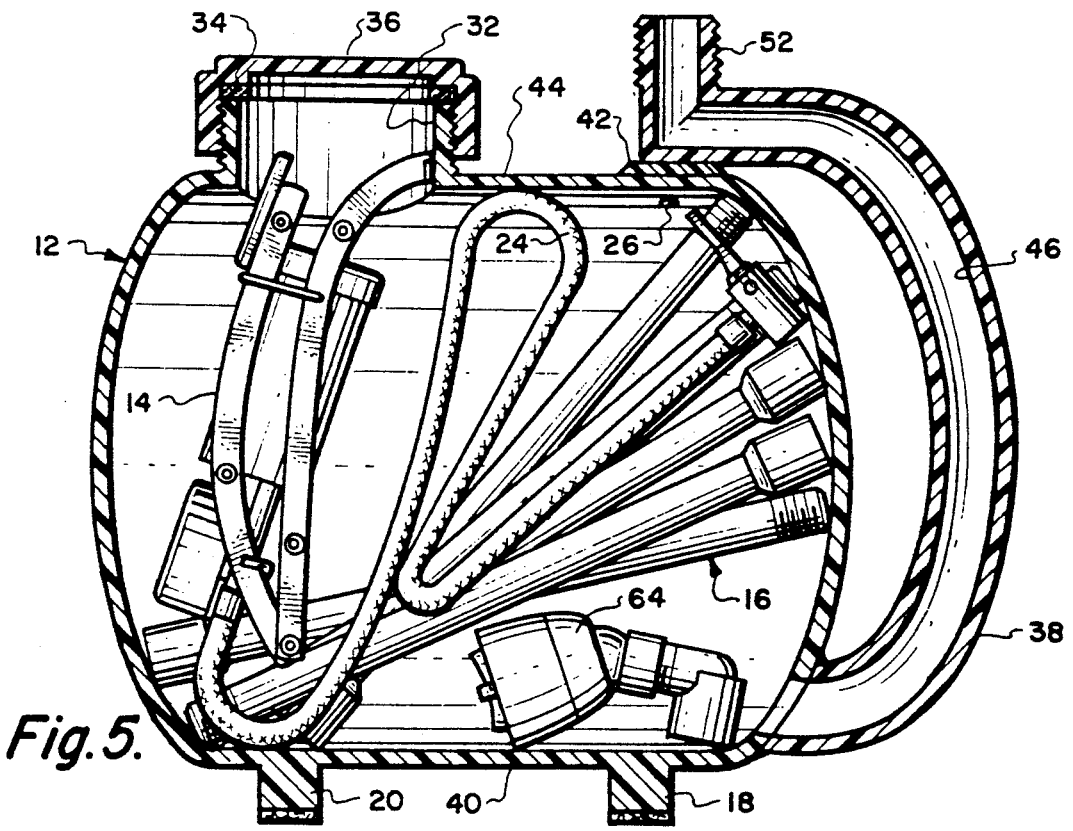
FIG. 5 is a view similar to FIG. 4 but showing the tank empty and the different parts of the portable shower of the present invention located within the internal chamber of the tank.

The portable shower 10 of the present invention is composed generally of a tank 12, an air pump assembly 14 and a vertically rising conduit assembly 16. The tank 12 includes planer foot pads 18 and 20 which are formed integral with the tank 12 and are to be placed on a supportive surface 22 which in most instances will be ground. An air pressure pump 14 will normally be foot operated and is deemed to be conventional and forms no specific part of this invention. Such types of air pressure pumps are well known and are readily available to be purchased by anyone.

The air pump assembly 14 supplies pressurized air through an air supply conduit 24 to an air inlet opening 26 mounted through the side wall of the tank 12. A manually operated valve 28 is connected between the opening 26 and the conduit 24 which can be opened and closed to either supply pressurized air to within the internal chamber 30 to the tank 12 or close the internal chamber 30 to the ambient by preventing escape of any pressurized air contained within the chamber 30. The exterior wall surface of the tank 12 is to be a dark color such as black which means that the wall surface of the tank 12 could be constructed of a black color or the exterior surface could be painted black.

In order to gain access into the internal chamber 30 there is located an enlarged fill opening 32. Surrounding the fill opening 32 is an upstanding cylindrical wall surface 34 which is externally threaded. Connectable with the threaded section of the wall surface 34 is a cap 36. It is to be understood that the cap 36 can be easily manually removed.

It is to be noted that the actual physical size of the fill opening 32 is quite large. Typically the size of the fill opening 32 will be four to six inches and the reason for this will become apparent further on in this specification.

Integrally connected with the wall of tank 12 is a water supply conduit 38. The water supply conduit 38 is located exteriorly of tank 12. One end of the conduit 38 connects to tank 12 directly adjacent the lower edge 40 with the opposite end of the conduit 38 being permanently secured to a mounting pad 42 which is permanently mounted on the top edge 44 of the tank 12. The water supply conduit 38 includes a through passage 46 through which water 48 from the internal chamber 12 is to flow. The water from the passage 46 is to flow into piping segment 50. Piping segment 50 is screw threadingly connected to screw threaded section 52 of the water supply conduit 38. Piping segment 50 has a female end 54 which connects with threaded section 52. The outer end of the piping segment 50 terminates in a male end 56 which is also externally threaded.

The male end 56 threadably connects with another piping segment 58 which is basically identical to the piping segment 50. This procedure is repeated with piping segment 58 connecting with another piping segment 60 and that piping segment in turn connecting with the uppermost piping segment 62. It is therefore made apparent that there are four in number of the piping segments 50, 58, 60 and 62 which make up the vertically rising conduit assembly. It is to be understood that it is within the scope of this invention that a greater or lesser number of piping segments could be utilized without departing from the scope of this invention. The piping segment 62 is then threadingly connected to a shower head 64. The actual construction of the shower head 64 is conventional and forms no specific part of this invention.

When water 48, normally amounting to about five gallons, is contained within the internal chamber 30 and the cap 36 is tightly installed, the valve 28 is to be opened. The user then proceeds to operate the air pump assembly 14 which will cause air pressure to build up within the internal chamber 30. This will apply pressure against the water 48 and force such through the passage 46 of water supply conduit 38, through the piping segments 50, 58, 60 and 62 and into the shower head 64. The water will then be dispensed from the shower head 64.

When it is desired to no longer utilize the portable shower 10 of this invention, the internal chamber 30 is emptied of the water 48. The piping segments 50, 58, 60 and 62 are separated into their individual segments with the shower head 6 also being disconnected from piping segment 62. The segments, 50, 58, 60 and 62, as well as the shower head 64 can then be located within the internal chamber 30. Also, the air pump assembly 14 can be located within the internal chamber 30. The cap 36 is then installed in place in a snug manner and the portable shower 10 of this invention is in the position for transportability. The user is to grasp the exterior wall surface of the water supply conduit 38 which then functions as a handle to facilitate carrying of the portable shower 10 of this invention to any location that is desired.

What is claimed is:

1. A portable shower to be used by a human being comprising:

a shower head which is to dispense water in a spray pattern;

a rigid, self supporting, vertically rising, conduit assembly connected to said shower head and providing a path for water to flow through said conduit assembly to said shower head;

a tank having an enclosed internal chamber, a stored quantity of water to be located within said internal chamber, said tank having a top edge and bottom edge, said bottom edge to be located directly adjacent a supporting surface, said top edge being spaced furthest from said bottom edge;

a water supply conduit connecting to said tank, said water supply conduit connecting with said internal chamber directly adjacent said bottom edge with said stored quantity of water to be flowable from said internal chamber into said water supply conduit, said vertically rising conduit assembly connecting with said water supply conduit directly adjacent said top edge, said water supply conduit being located exteriorly of said tank, the exterior wall of said water supply conduit being fixed to said tank at said top edge, the portion of said water supply conduit between said top edge and said bottom edge being spaced from said tank so as to form a graspable handle to facilitate manual carrying of said tank, said tank having a fill opening for supplying water into said internal chamber, said fill opening being located at said top edge, a cap connecting with said fill opening, said cap being removably engaged with said fill opening; and air pressure means connected with said tank, said air pressure means for increasing the air pressure within said internal chamber which will cause the water to flow from said internal chamber through said conduit assembly and said shower head into the ambient.

2. The portable shower as defined in claim 1 wherein:

said fill opening being of sufficient size so as to facilitate insertion of said segments into said internal chamber during the time that said portable shower is not being used, said segments to be easily removable from said internal chamber, said fill opening being between four and six inches in diameter.

3. The portable shower as defined in claim 2 wherein:

said air pressure means comprising a foot operated pump, said foot operated pump being of a size to be insertable through said fill opening and stored within said internal chamber during non-usage of said portable shower.

* * * * *